US012435502B2

(12) United States Patent
Sudol, Jr.

(10) Patent No.: US 12,435,502 B2
(45) Date of Patent: Oct. 7, 2025

(54) FLUSH VALVE AND TOILET ASSEMBLY

(71) Applicant: AS America, Inc., Piscataway, NJ (US)

(72) Inventor: Richard B. Sudol, Jr., Plainfield, NJ (US)

(73) Assignee: AS America, Inc., Piscataway, NJ (US)

( * ) Notice: Subject to any disclaimer, the term of this patent is extended or adjusted under 35 U.S.C. 154(b) by 191 days.

(21) Appl. No.: 18/035,978

(22) PCT Filed: Nov. 22, 2021

(86) PCT No.: PCT/US2021/060307
§ 371 (c)(1),
(2) Date: May 9, 2023

(87) PCT Pub. No.: WO2022/109382
PCT Pub. Date: May 27, 2022

(65) Prior Publication Data

US 2023/0417039 A1 Dec. 28, 2023

Related U.S. Application Data

(60) Provisional application No. 63/117,216, filed on Nov. 23, 2020.

(51) Int. Cl.
*E03D 11/18* (2006.01)
*E03D 11/02* (2006.01)

(52) U.S. Cl.
CPC ..... *E03D 11/18* (2013.01); *E03D 11/02* (2013.01)

(58) Field of Classification Search
CPC ..... E03D 11/02; E03D 11/18
See application file for complete search history.

(56) References Cited

U.S. PATENT DOCUMENTS

| | | | | |
|---|---|---|---|---|
| 380,854 | A | 4/1888 | Boyle | |
| 423,022 | A | 3/1890 | Boyle | |
| 439,630 | A | 11/1890 | Boyle | |
| 5,142,712 | A * | 9/1992 | Hennessy | E03D 11/00 4/328 |
| 7,010,816 | B2 | 3/2006 | Li | |
| 7,159,251 | B2 * | 1/2007 | Hennessy | E03D 1/22 4/324 |
| 8,141,179 | B2 | 3/2012 | Hennessy | |
| 8,196,231 | B2 | 6/2012 | Hennessy | |
| 8,266,732 | B1 | 9/2012 | Wang et al. | |

(Continued)

FOREIGN PATENT DOCUMENTS

CN 201635158 U 11/2010

OTHER PUBLICATIONS

International Search Report mailed Feb. 15, 2022 in corresponding International Application No. PCT/US21/60307 (2 pages).

*Primary Examiner* — Janie M Loeppke
(74) *Attorney, Agent, or Firm* — Tyler A. Stevenson; Anna-lisa L. Gallo

(57) ABSTRACT

A toilet assembly, comprising a toilet tank to hold flush water; a flush valve assembly positioned in the toilet tank; a toilet bowl; and a trapway in flow communication with the toilet bowl; wherein the trapway comprises a sump trap, a first upstream weir, a lower trap, and a second downstream weir, and wherein the first upstream weir is positioned about 2.0 inches or more vertically above a highest point of a trapway inlet.

17 Claims, 3 Drawing Sheets

(56) References Cited

U.S. PATENT DOCUMENTS

| | | | | |
|---|---|---|---|---|
| 8,943,621 | B2 * | 2/2015 | Wang | E03D 1/34 4/370 |
| 10,047,510 | B2 | 8/2018 | Cummings et al. | |
| 10,597,859 | B2 | 3/2020 | Hennessy et al. | |
| 2017/0314246 | A1 | 11/2017 | Wagner | |
| 2020/0018055 | A1 | 1/2020 | Garrels et al. | |
| 2021/0140162 | A1 | 5/2021 | Hennessy et al. | |

* cited by examiner

FLUSH VALVE AND TOILET ASSEMBLY

The disclosure relates to a flush valve assembly for a toilet, for example where the toilet is capable of providing a high energy flush with reduced flush water volumes.

BACKGROUND

Typically, toilets incorporate three systems that work together to perform the flushing action: a bowl siphon, a flush mechanism, and a refill mechanism. Working in concert, these three systems allow for and complete a flush cycle of a toilet. A tank, usually positioned over the back of the bowl, contains water that is used to initiate siphoning from the bowl to a sewage line, after which fresh water refills the bowl. When an operator desires to flush the toilet, he or she manipulates a flush lever on the outside of the tank, which is connected on the inside of the tank to a movable chain or lever. Upon operation, a flush lever moves a chain or lever on the tank interior, thereby lifting and opening a flush valve and causing water to flow from the tank and into the bowl initiate a toilet flush cycle.

In many toilet designs, water flows directly into the bowl and disperses into a bowl rim. The water releases into the bowl rather quickly, with flow from the tank into the bowl typically lasting approximately 2 to 4 seconds. The water flows from the rim, down a channel within the sides of the bowl and into a large hole at the bottom of the toilet (commonly known as a siphon jet). A siphon jet releases water into an adjoining siphon tube, thereby initiating a siphon action. A siphon action draws water and waste out of the bowl and into the siphon tube. Waste and water continues through the siphon tube and through a trapway and is released into a wastewater line. Once a tank is emptied of its contents during a flush, the flush valve closes, and a floating mechanism which has now dropped in the tank to some residual amount initiates opening of a fill valve. A fill valve provides fresh water to both the tank and the bowl through separate flows. Eventually the tank fills with water to a high enough level to cause the float to rise, thus shutting off the fill valve. At this point, a flush cycle is complete.

Excessive consumption of potable water remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush). High-efficiency toilets that use 1.28 gallons per flush (gpf) or less can be certified under the EPA's WaterSense program.

Desired are low volume and/or high-efficiency toilets having a higher energy flush and a more powerful siphon.

SUMMARY

Accordingly, disclosed is a toilet assembly, comprising a toilet tank to hold flush water; a flush valve assembly positioned in the toilet tank; a toilet bowl; a trapway in flow communication with the toilet bowl; and a container positioned in the toilet tank, wherein the container is in flow communication with the toilet tank, the container having an open lower end and a closed upper end, the trapway comprises a sump trap, a first upstream weir, a lower trap, and a second downstream weir, a conduit extends from an interior of the container to the trapway, is coupled to the trapway at a position between the sump trap and the lower trap, and provides flow communication between the container and the trapway, and wherein, the first upstream weir is positioned about 2.0 inches or more vertically above a highest point of a trapway inlet.

Also disclosed is a toilet tank assembly, comprising a toilet tank to hold flush water; a flush valve assembly positioned in the toilet tank; a container positioned in the toilet tank; and a conduit positioned in an interior of the container, wherein the container is in flow communication with the toilet tank, the container having an open lower end and a closed upper end, the conduit is configured to extend from the container interior to a toilet trapway.

Also disclosed is a siphon flush assembly, comprising a flush valve assembly; and a container, wherein the container comprises an open lower end and a closed upper end. In some embodiments, the container is configured to contain a flush water portion and an air portion, and wherein an upper end of a conduit is positioned in the air portion.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

Figure 1:
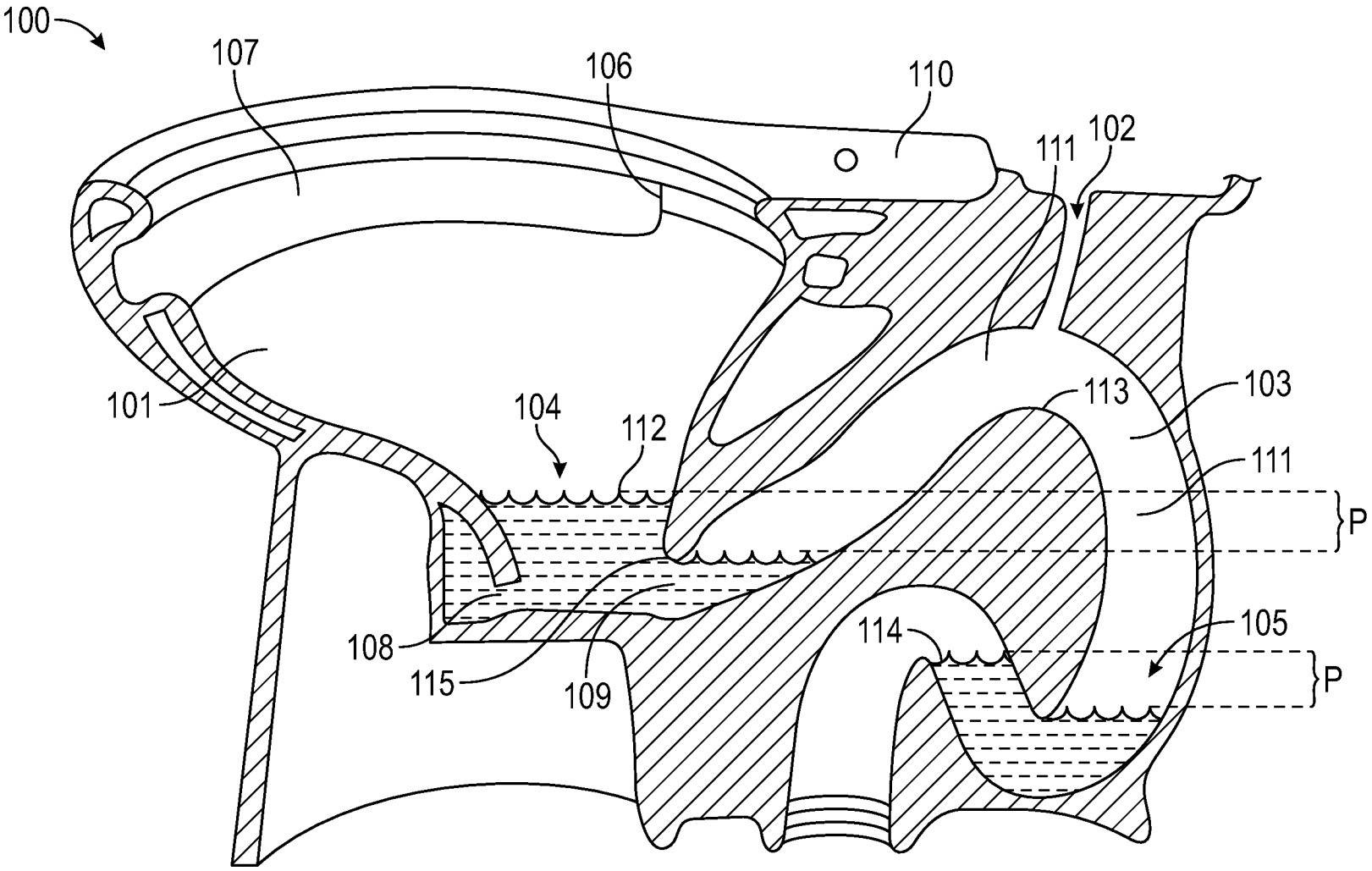
FIG. 1 shows a cross-section view of a partial toilet assembly, according to an embodiment.

FIG. 1 provides a cross-section view of partial toilet assembly 100, according to an embodiment. Shown are bowl 101, conduit 102, trapway 103, sump trap 104, and lower trap 105. Lower trap 105 is downstream of sump trap 104 and conduit 102 is coupled to trapway 103 at a position between lower trap 105 and sump trap 104. Also shown are rim outlet 106 and rim channel 107, and jet outlet 108 and trapway inlet 109. A toilet tank having a flush valve assembly positioned therein (not shown) may be positioned on toilet deck 110. With a flush valve assembly in a closed position, an air volume defined by a combined volume of an upper end of a container (not shown), conduit 102, and trapway portion 111 between sump trap 104 and lower trap 105 may be under a positive pressure. Trapway portion 111 may be defined as "portion between sump trap 104 and lower trap 105", meaning from a downstream water level of sump trap 104 to upstream water level of lower trap 105. A positive pressure P is shown, which may for example be from about 0.5 cm to about 5.0 cm of water above atmospheric pressure. Pressure P results in the presence of a larger water spot 112 (water seal). Trapway 103 contains first weir 113 and second weir 114. First upstream weir 113 lies about 3 inches (about 7.62 cm) vertically above trapway inlet 109 highest point 115.

Figure 2A:
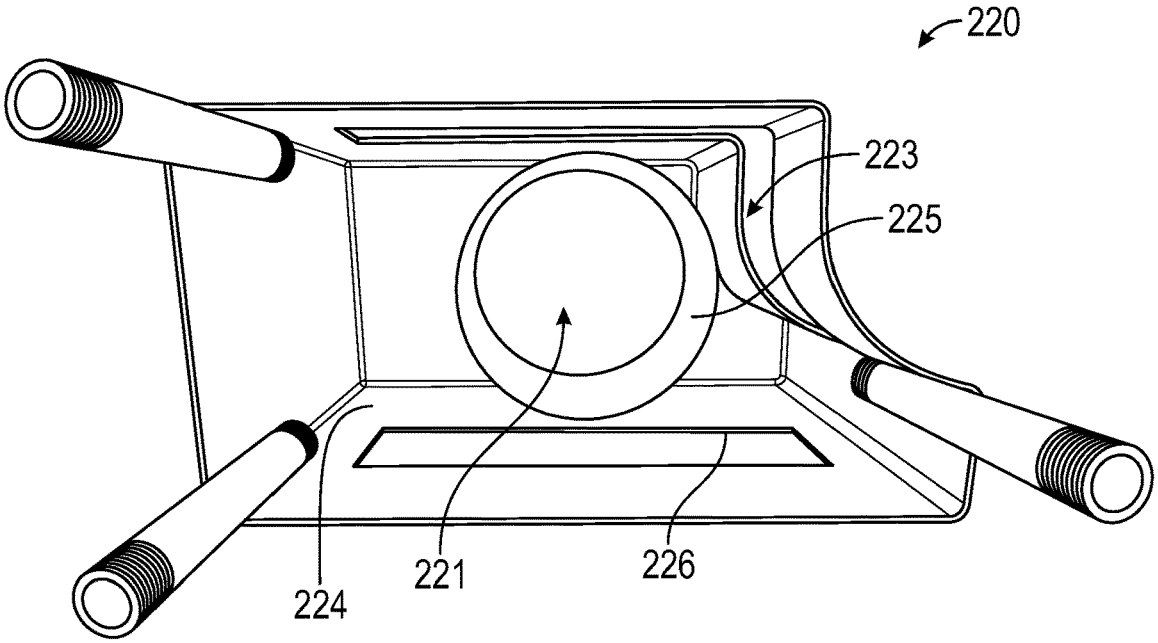
FIG. 2A and FIG. 2B provide views of a container to be positioned in a toilet tank, according to an embodiment.
Figure 2B:
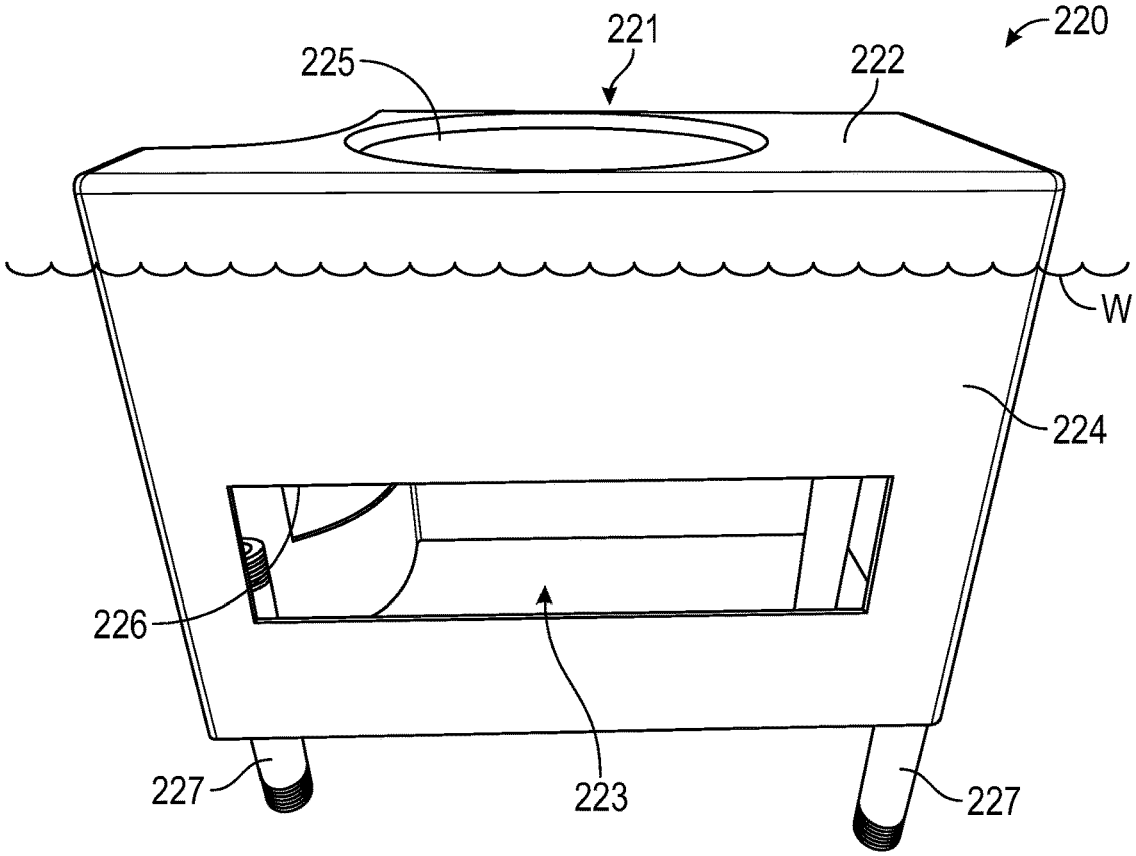

FIG. 2A and FIG. 2B show a bottom view and a front view of container 220, respectively, according to an embodiment. Container 220 contains opening 221 to receive a flush valve assembly. Container 220 comprises a closed upper end 222, open lower end 223, and container upper walls 224. Container 220 is configured to sit in a toilet water tank and to receive a flush valve assembly in opening 221. Container upper walls 224, opening wall 225, closed upper end 222, and lower edge 226 define an interior space of container 220. Opening wall 225 extends downward to the same or about the same point as lower edge 226. An interior space of container 220 may contain a toilet tank water portion and an air portion between flush cycles. Water level W represents a toilet water tank level prior to initiation of a flush cycle (between flush cycles), according to an embodiment. An interior of container 220 will hold tank water from level W to wall lower edge 226, and will hold an air portion from water level W to closed upper end 222, when at rest between flush cycles. In an embodiment, legs 227 may be provided. Legs 227 may be adjustable which may allow adjustment of air pressure.

Figure 3:
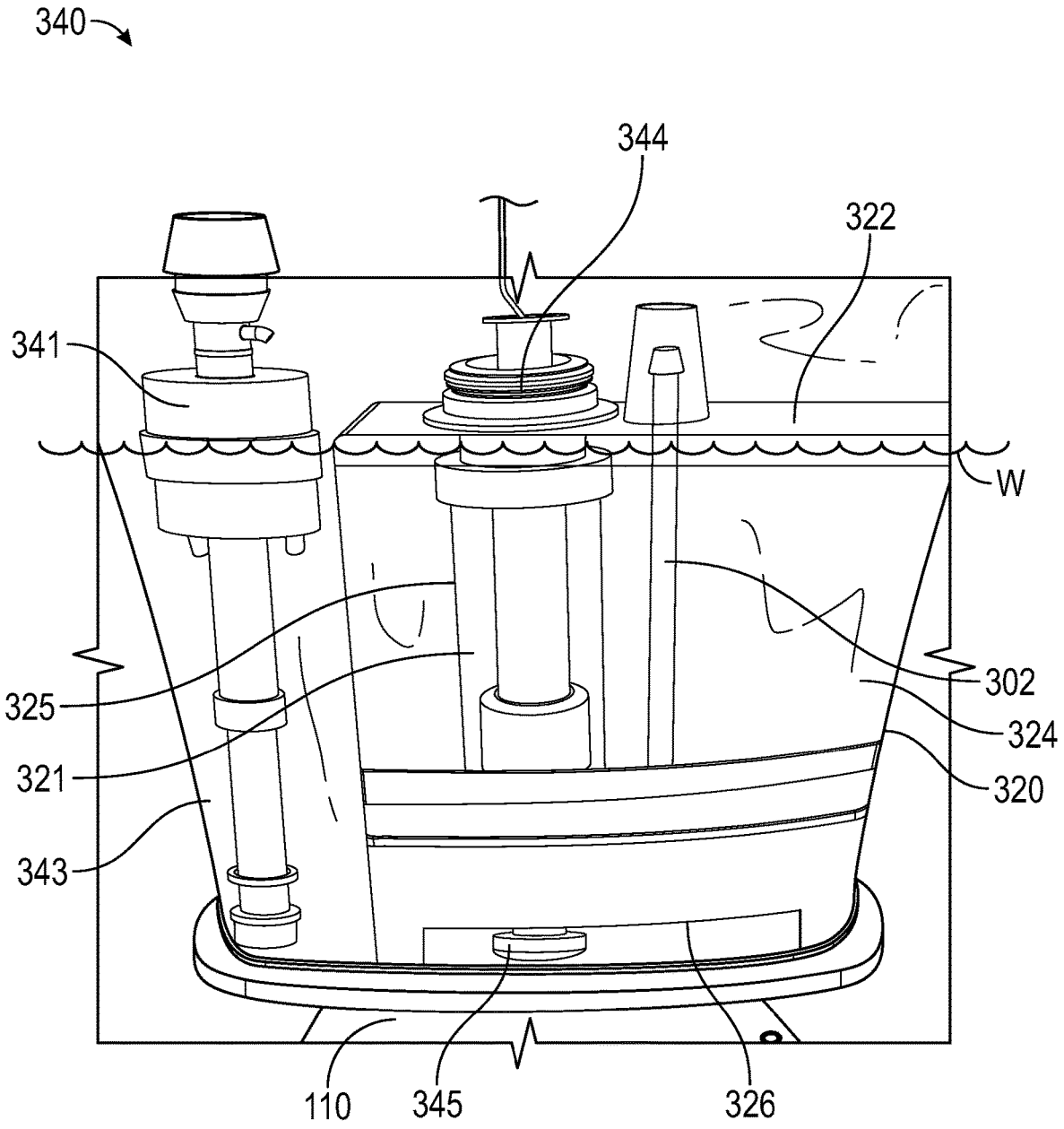
FIG. 3 provides a view of a toilet tank assembly, according to an embodiment.

FIG. 3 provides a view of toilet tank assembly 340, according to an embodiment. Visible are fill valve 341 and see-through container 320 positioned in see-through toilet tank 343. An upper end of conduit 302 is configured to be positioned above a water line W in an air portion of container 320 between flush cycles. Conduit 302 is configured to couple to a trapway between a bowl sump trap and a lower trap. A "conduit" in total means from an upper end of a conduit to a connection point at a trapway. Flush valve assembly 344 is positioned in container opening 321 having opening wall 325. Container 320 has closed upper end 322, walls 324, and lower edge 326. Visible is tank outlet 345. Tank assembly 340 is positioned on deck 110 of toilet assembly 100.

A toilet bowl comprises a rim extending at least partially around an upper perimeter of the bowl, an interior surface, and a sump area. In some embodiments, a rim may define a rim channel extending from a rim inlet port and around an upper perimeter of the bowl and having at least one rim outlet port in fluid communication with an interior surface of the bowl. Fluid flow through a rim channel may serve to clean the bowl. In an embodiment, a bowl may have a rim shelf extending transversely along an interior surface of the bowl from a rim inlet port at least partially around the bowl so that fluid is configured to travel along the rim shelf and enter the bowl interior in at least one location displaced from the rim inlet port.

A bowl sump area is in fluid communication with a trapway inlet. A bowl sump area may define a sump trap. In some embodiments, a portion of an interior wall of the bowl in the sump area may be configured to upwardly incline from a jet outlet port toward the trapway inlet.

The sump area of the bowl in one embodiment has a sump trap defined by the interior surface of the bowl and having an inlet end and an outlet end, wherein the inlet end of the sump trap receives fluid from the jet outlet port and/or the interior area of the bowl and the outlet end of the sump trap is in fluid communication with the trapway inlet; and wherein the sump trap has a seal depth. An upper surface or uppermost point of the jet outlet port may be within the sump trap and positioned at a seal depth below an upper surface of the trapway inlet as measured longitudinally (vertically) through the sump area. In some embodiments, a sump trap seal depth may be from any of about 1 cm, about 2 cm, about 3 cm, about 4 cm or about 5 cm to any of about 6 cm, about 7 cm, about 8 cm, about 9 cm, about 10 cm, about 11 cm, about 12 cm, about 13 cm, about 14 cm or about 15 cm or more.

In some embodiments, a toilet assembly may comprise a jet defining at least one jet channel, the jet channel extending from a jet inlet port in fluid communication with a flush valve to a jet outlet port positioned in a bowl sump area and configured for discharging fluid through the sump area to a trapway. In some embodiments, a jet channel, once primed with fluid, is capable of remaining primed before actuation of and after completion of a flush cycle.

A trapway is in fluid communication with a sump area of a toilet bowl and with a waste outflow line. In some embodiments, a trapway may have a shape defining a first upstream weir and a second downstream weir. A trapway may comprise a sump trap, the sump trap providing a bowl water spot (water seal). A trapway may also comprise a lower trap positioned downstream of a sump trap. A first upstream weir may be positioned in a trapway portion defined from a downstream water level of a sump trap to an upstream water level of a lower trap (between the sump trap and lower trap). In some embodiments, a conduit may be coupled to a trapway portion between the sump trap and lower trap. In some embodiments, a conduit may be coupled to a trapway at or near a first weir.

In some embodiments, a conduit portion coupled to a trapway may be integrally formed in chinaware, and may be configured to couple to a conduit portion of a flush valve assembly. In other embodiments, a conduit portion coupled to a trapway may comprise a thermoplastic. In some embodiments, a conduit running from a flush valve assembly to a trapway may be a unitary structure, or may comprise two or more separate segments coupled together. A conduit in total includes conduit portions from an upper end to a connection point at a trapway.

A siphon flush assembly may comprise a flush valve assembly and a container. A container may generally be defined by a continuous side wall and top wall (upper end). A continuous wall may comprise side walls of a rectangular-shaped box-like structure, a cylinder-like structure, or an irregular structure as shown in the figures. In some embodiments, an upper end may comprise a cylinder-shaped opening to receive a siphon flush valve. A container opening may generally be centered, or may be off-center. A container opening may comprise a continuous wall, which wall may extend downward to about a same point as a container wall lower edge, or, alternatively, to a lower or higher point than a container wall lower edge (thereby a container upper end remains "closed"). In some embodiments, a container may comprise 2 or more legs. Legs may be configured to allow vertical adjustment of a container.

In some embodiments, a container may have other shapes, for example a cylinder-like shape, pyramid-like shape, a sphere- or spheroidal-like shape, an ovoid shape, a cone shape, an ellipsoid-like shape, partial shapes thereof, and the like.

In some embodiments, a siphon flush assembly comprises a container having an open lower end and a closed upper end. A conduit portion may be positioned at an interior of the container. A conduit runs from the container interior to a trapway, and provides flow communication between the container interior and the trapway. In some embodiments, an "open lower end" may mean a container may have one or more openings positioned in a container wall. In some embodiments, a container may have one or more openings positioned towards a lower end thereof. In some embodiments, a container may have a plurality of openings positioned at or near a lower end thereof.

In a pre-flush condition (between flush cycles), a toilet tank water level may be positioned at, near, or below a top upper edge of a container and above a container lower edge. In some embodiments, a container may have a closed upper end. In a pre-flush condition, a container may contain a level of toilet tank water in a lower end and an air portion in an upper end. An upper end of a conduit may be positioned in the air portion. In some embodiments, a container may contain essentially no air between flush cycles, or just enough air to cover an upper end of a conduit.

A flush cycle is completed upon re-filling the toilet tank, a sump trap, and a lower trap. Upon completion of a flush cycle, new flush water entering the toilet tank also enters the container via an open lower end and/or one or more openings positioned in a container wall. Entry of water into the container may compress air into a container upper end, and may return an air volume defined by a container upper end, a conduit, and a trapway portion between a sump trap and a lower trap to atmospheric pressure or a positive pressure (increased pressure) above atmospheric. In some embodiments, a positive air pressure above atmospheric may be from any of about 0.5 cm of water, about 0.8 cm of water, about 1.1 cm of water, about 1.4 cm of water, about 1.7 cm of water, about 2.0 cm of water, about 2.3 cm of water, about 2.6 cm of water, or about 2.9 cm of water, to any of about 3.2 cm of water, about 3.5 cm of water, about 3.8 cm of water, about 4.1 cm of water, about 4.4 cm of water, about 4.7 cm of water, about 5.0 cm of water, or more.

Upon initiation of a flush cycle, flush water is discharged from the toilet tank and the container through the flush valve. This exerts a negative pressure on the air volume defined by the container upper end, conduit, and trapway portion between a sump trap and a lower trap. The negative pressure (reduced pressure) may mean a drop to atmospheric pressure or a partial vacuum. The negative pressure helps create a siphon to pull water and waste through the sump area and into and out of the trapway.

In some embodiments, a conduit may comprise a backflow preventer to prevent waste water from entering the conduit.

A container may comprise an open lower end and/or one or more openings positioned in a container wall, configured to provide fluid communication between a container interior space and a toilet tank. In some embodiments, a container may comprise one or more openings positioned towards a lower end thereof.

In some embodiments, a toilet assembly is configured so that an inadvertent loss of air pressure in an air volume between flush cycles is prevented.

In some embodiments, a toilet assembly may be configured for an operator to choose for instance a "full flush" of about 1.6 gallons (about 6 liters) of water to eliminate solid waste or a "partial flush" (short flush) of a lower volume or water, for example about 1.1 gallons (about 4 liters), for the removal of liquid waste. A choice of flush volume may depend on a valve open time.

In some embodiments, a first upstream weir (a highest point of the weir) may be positioned about 2.0 inches or more vertically above an upper point (highest point) of a trapway inlet. In some embodiments a first upstream weir may be positioned from any of about 2.0 inches, about 2.2 inches, about 2.4 inches, about 2.6 inches, or about 2.8 inches, to any of about 2.9 inches, about 3.0 inches, about 3.2 inches, about 3.3 inches, about 3.4 inches, about 3.5 inches, about 3.6 inches, about 3.7 inches, about 3.8 inches, about 4.0 inches, or more, vertically above a trapway inlet upper point.

In some embodiments, a first upstream weir may positioned at a height which is vertically higher than a toilet bowl water seal. This arrangement may prevent inadvertent emptying of the sump trap and the lower trap via a siphon effect. Emptying of the sump trap and the lower trap may occur if a volume of fluid is placed in the bowl without flushing, and would result in an undesired loss of a water seal. In some embodiments, a first upstream weir may be positioned at a height of from any of about 0.2 inches, about 0.3 inches, about 0.4 inches, about 0.5 inches, or about 0.6 inches, to any of about 0.7 inches, about 0.8 inches, about 0.9 inches, about 1.0 inches, about 1.1 inches, about 1.2 inches, about 1.3 inches, about 1.4 inches, about 1.5 inches, about 1.6 inches, about 1.7 inches, or more, above a toilet bowl water seal.

A flush valve assembly may comprise a flush valve body extending from a flush valve inlet to a flush valve outlet. In a closed position, a valve cover is positioned with a seal seated on and enclosing a flush valve inlet. In some embodiments, a seal may comprise an elastomer or other flexible polymer, for example flexible silicone or polyvinyl chloride. In some embodiments, a valve cover may be coupled to a chain or lever configured to lift the valve cover and open the valve.

In some embodiments, a flush valve body may comprise a radiused (rounded) fluid inlet. In some embodiments, a radiused flush valve inlet may have an outer diameter of from any of about 3.7 inches, about 3.8 inches, about 4.0 inches, about 4.2 inches, about 4.4 inches, or about 4.6 inches, to any of about 4.8 inches, about 5.0 inches, about 5.2 inches, about 5.4 inches, or more. In some embodiments, a radiused flush valve inlet may have an inner diameter of from any of about 2.6 inches, about 2.8 inches, about 3.0 inches, or about 3.2 inches, to any of about 3.4 inches, about 3.6 inches, about 3.8 inches, about 4.0 inches, or more.

In some embodiments, a flush valve body may comprise an annular base section having a fluid outlet. In some embodiments, an annular base section and fluid outlet may have an inner diameter of from any of about 2.4 inches, about 2.5 inches, about 2.6 inches, about 2.7 inches, about 2.8 inches, or about 2.9 inches, to any of about 3.0 inches, about 3.1 inches, about 3.2 inches, about 3.3 inches, about 3.4 inches, about 3.5 inches, about 3.6 inches, about 3.7 inches, about 3.8 inches, about 3.9 inches, about 4.0 inches, or more.

In some embodiments, a flush valve body may have a tapered portion, wherein a flush valve body inner diameter gradually decreases. In some embodiments, a flush valve body may comprise a tapered portion wherein the flush valve body inner diameter gradually decreases from a radiused fluid inlet to an annular base portion.

In some embodiments, when installed in a toilet tank, a flush valve body may extend from at or about at a toilet tank floor surface to a flush valve outlet. In other embodiments, when installed in a toilet tank, a flush valve body may extend from above a toilet tank floor surface to a flush valve outlet.

In some embodiments, a flush valve body may have an overflow tube coupled to it. In some embodiments, an overflow tube may be coupled to a flush valve body tapered section. An overflow tube may be in flow communication with the valve body. In some embodiments, a fill valve may be configured to provide fresh flush water to a bowl via an overflow tube after a flush has been performed. In other embodiments, a flush valve assembly comprises no overflow tube. In some embodiments, bowl refill is accomplished via directing a certain amount of refill water through a jet outlet into the sump area towards the end of a flush cycle.

Suitable flush valve assemblies are shown in U.S. Pat. No. 8,079,095, according to some embodiments. The relevant portions of U.S. Pat. No. 8,079,095 are incorporated by reference.

In some embodiments, with a flush valve assembly in a closed position prior to initiation of a flush cycle, a container may contain a level of tank water at a lower end and an air portion at an upper end. In some embodiments, an upper end of a conduit is positioned in the air portion. In some embodiments, an upper portion of a container will be positioned above a toilet tank water level with a flush valve assembly in a closed position. In some embodiments, a container may contain essentially no air between flush cycles, or just enough air to cover an upper end of a conduit.

To initiate a flush cycle, an operator may manipulate a lever positioned on an outside of a toilet tank. The lever may be connected at a tank interior to a moveable chain or other linkage, which chain or linkage may be coupled to a flush valve cover. Upon operation of the lever, the chain or linkage may be configured to lift the flush valve cover to open the flush valve and to pass flush water to a rim and/or jet of the toilet bowl.

Following are some non-limiting embodiments of the disclosure.

In a first embodiment, disclosed is a toilet assembly, comprising a toilet tank to hold flush water; a flush valve assembly positioned in the toilet tank; a toilet bowl; a trapway in flow communication with the toilet bowl; and a container positioned in the toilet tank, wherein the container is in flow communication with the toilet tank, the container having an open lower end and a closed upper end, the trapway comprises a sump trap, a first upstream weir, a lower trap, and a second downstream weir, a conduit extends from an interior of the container to the trapway, is coupled to the trapway at a position between the sump trap and the lower trap, and provides flow communication between the container and the trapway, and wherein, the first upstream weir is positioned about 2.0 inches or more vertically above a highest point of a trapway inlet.

In a second embodiment, disclosed is a toilet assembly according to embodiment 1, wherein the first upstream weir is positioned about 2.5 inches or more vertically above the trapway inlet highest point. In a third embodiment, disclosed is a toilet assembly according to embodiment 1, wherein the first upstream weir is positioned about 3.0 inches or more vertically above the trapway inlet highest point.

In a fourth embodiment, disclosed is a toilet assembly according to any of the preceding embodiments, wherein, when between flush cycles, the first upstream weir is positioned at a vertically higher point than a toilet bowl water seal. In a fifth embodiment, disclosed is a toilet assembly according to any of the preceding embodiments, wherein, when between flush cycles, the first upstream weir is positioned at a vertical height above a toilet bowl water seal of from about 0.2 inches to about 1.7 inches.

In a sixth embodiment, disclosed is a toilet assembly according to any of the preceding embodiments, wherein, when between flush cycles, the toilet assembly comprises an air volume defined by an upper end of the container, the conduit, and a portion of the trapway between the sump trap and the lower trap.

In a seventh embodiment, disclosed is a toilet assembly according to any of the preceding embodiments, wherein, when between flush cycles, the container contains a toilet tank water portion and an air portion. In an eighth embodiment, disclosed is a toilet assembly according to embodiment 7, wherein an upper end of the conduit is configured to be positioned in the air portion.

In a ninth embodiment, disclosed is a toilet assembly according to any of embodiments 6 to 8, wherein, upon opening the flush valve to initiate a flush cycle, reduced pressure is created in the air volume. In a tenth embodiment, disclosed is a toilet assembly according to any of embodiments 6 to 9, wherein, upon re-filling the toilet tank with water to end a flush cycle, increased pressure is created in the air volume. In an eleventh embodiment, disclosed is a toilet assembly according to any of embodiments 6 to 10, wherein when between flush cycles, the air volume is under a positive pressure of from about 0.5 cm to about 5.0 cm of water above atmospheric pressure.

In a twelfth embodiment, disclosed is a toilet assembly according to any of the preceding embodiments, wherein the container comprises a continuous side wall and a top, upper end wall. In a thirteenth embodiment, disclosed is a toilet assembly according to any of the preceding embodiments, wherein the container comprises a box-like shape or an irregular box-like shape.

In a fourteenth embodiment, disclosed is a toilet assembly according to any of the preceding embodiments, wherein the conduit comprises a backflow preventer.

In a fifteenth embodiment, disclosed is a toilet assembly according to any of the preceding embodiments, wherein the flush valve assembly comprises a valve body extending from a valve inlet to a valve outlet and a valve cover having a seal to enclose the valve inlet. In a sixteenth embodiment, disclosed is a toilet assembly according to embodiment 15, wherein the flush valve assembly comprises a chain or lever coupled to the valve cover. In a seventeenth embodiment, disclosed is a toilet assembly according to embodiment 16, wherein a container upper end comprises an opening to receive the chain or lever, the container opening comprising a continuous wall extending downward from the container upper end.

In an eighteenth embodiment, disclosed is a toilet tank assembly, comprising a toilet tank to hold flush water; a flush valve assembly positioned in the toilet tank; a container positioned in the toilet tank; and a conduit positioned in an interior of the container, wherein the container is in flow communication with the toilet tank, the container having an open lower end and a closed upper end, the conduit is configured to extend from the container interior to a toilet trapway.

In a nineteenth embodiment, disclosed is a siphon flush assembly, comprising a flush valve assembly; and a container, wherein the container comprises an open lower end and a closed upper end. In a twentieth embodiment, disclosed is a siphon flush assembly according to embodiment 19, comprising a conduit positioned in the container.

In a twenty-first embodiment, disclosed is a siphon flush assembly according to embodiments 19 or 20, wherein the container is configured to contain a flush water portion and an air portion, and wherein an upper end of the conduit is positioned in the air portion. In a twenty-second embodiment, disclosed is a siphon flush assembly according to any of embodiments 19 to 21, wherein the container upper end comprises an opening to receive a flush valve assembly chain or lever, the container opening comprising a continuous wall extending downward from the container upper end.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A toilet assembly, comprising
a toilet tank to hold flush water;
a flush valve assembly positioned in the toilet tank;
a toilet bowl;
a trapway in flow communication with the toilet bowl;
a container positioned in the toilet tank, and
a conduit extending from an interior of the container to the trapway,
wherein
the container is in flow communication with the toilet tank, the container having an open lower end and a closed upper end,
the trapway comprises a sump trap, a first upstream weir, a lower trap, and a second downstream weir, and
the conduit is coupled to the trapway at a position between the sump trap and the lower trap, and provides flow communication between the container and the trapway,
the first upstream weir is positioned 2.0 inches or more vertically above a highest point of a trapway inlet,
the sump trap contains a toilet bowl water seal between flush cycles,
the first upstream weir is positioned at a vertically higher point than the toilet bowl water seal,
the toilet assembly comprises an air volume defined by an upper end of the container, the conduit, and a portion of the trapway between the sump trap and the lower trap between flush cycles, and
the air volume is under a positive pressure above atmospheric pressure.

2. The toilet assembly according to claim 1, wherein the first upstream weir is positioned 2.5 inches or more vertically above the trapway inlet highest point.

3. The toilet assembly according to claim 1, wherein the first upstream weir is positioned 3.0 inches or more vertically above the trapway inlet highest point.

4. The toilet assembly according to claim 1, wherein the first upstream weir is positioned 0.2 inches or more above the toilet bowl water seal.

5. The toilet assembly according to claim 4, wherein the first upstream weir is positioned 0.4 inches or more above the toilet bowl water seal.

6. The toilet assembly according to claim 1, wherein the positive pressure is 0.5 cm of water or more above atmospheric pressure.

7. The toilet assembly according to claim 1, wherein, when between flush cycles, the container contains a toilet tank water portion and an air portion.

8. The toilet assembly according to claim 7, wherein an upper end of the conduit is configured to be positioned in the air portion.

9. The toilet assembly according to claim 8, wherein, upon opening the flush valve to initiate a flush cycle, reduced pressure is created in the air volume.

10. The toilet assembly according to claim 8, wherein, upon re-filling the toilet tank with water to end a flush cycle, increased pressure is created in the air volume.

11. The toilet assembly according to claim 1, wherein the positive pressure is from about 0.5 cm to 5.0 cm of water above atmospheric pressure.

12. The toilet assembly according to claim 1, wherein the container comprises a continuous side wall and a top, upper end wall.

13. The toilet assembly according to claim 1, wherein the container comprises a box-like shape or an irregular box-like shape.

14. The toilet assembly according to claim 1, wherein the conduit comprises a backflow preventer.

15. The toilet assembly according to claim 1, wherein the flush valve assembly comprises a valve body extending from a valve inlet to a valve outlet and a valve cover having a seal to enclose the valve inlet.

16. The toilet assembly according to claim 15, wherein the flush valve assembly comprises a chain or lever coupled to the valve cover.

17. The toilet assembly according to claim 16, wherein a container upper end comprises an opening to receive the chain or lever, the container opening comprising a continuous wall extending downward from the container upper end.

* * * * *